US010273672B2

(12) United States Patent
Harashima et al.

(10) Patent No.: US 10,273,672 B2
(45) Date of Patent: Apr. 30, 2019

(54) FLUSH TOILET

(71) Applicant: TOTO LTD., Kitakyushu-shi, Fukuoka (JP)

(72) Inventors: Tatsunari Harashima, Kitakyushu (JP); Ryoko Ishimaru, Kitakyushu (JP); Kenichi Nakamura, Kitakyushu (JP); Shoko Imaizumi, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/605,667

(22) Filed: May 25, 2017

(65) Prior Publication Data

US 2017/0350110 A1 Dec. 7, 2017

(30) Foreign Application Priority Data

Jun. 7, 2016 (JP) ..... 2016-113734

(51) Int. Cl.
*E03D 11/02* (2006.01)
*E03D 1/26* (2006.01)
*E03D 5/092* (2006.01)

(52) U.S. Cl.
CPC ..... *E03D 11/02* (2013.01); *E03D 1/26* (2013.01); *E03D 5/092* (2013.01)

(58) Field of Classification Search
USPC ..... 4/374
See application file for complete search history.

(56) References Cited

U.S. PATENT DOCUMENTS 9,021,622 B2 * 5/2015 Kitaura ..... E03D 1/085 4/300

* cited by examiner

*Primary Examiner* — Lauren A Crane
(74) *Attorney, Agent, or Firm* — Baker & Hostetler LLP

(57) ABSTRACT

A flush toilet includes a toilet main unit, a reservoir tank, and a connecting pipe member configured to connect the toilet main unit and the reservoir tank in a watertight manner after the connecting pipe member is inserted into the reservoir tank so that the reservoir tank is assembled to a predetermined installation position. The connecting pipe member includes a communicating pipe portion configured to communicate between the conduit of the toilet main unit and an interior of the tank when one end of the connecting member is inserted from the interior of the tank through the outlet of the tank into the inlet of the conduit of the toilet main unit. A horizontal adjustment portion configured to adjust the orientation of the reservoir tank to a horizontal state is provided on the toilet main unit or on the reservoir tank.

6 Claims, 14 Drawing Sheets

FLUSH TOILET

TECHNICAL FIELD

The present invention relates to a flush toilet, and more particularly to a flush toilet configured to be flushed with flush water supplied by using jet pump action so as to discharge waste.

BACKGROUND

For some time, known flush toilets configured to be flushed with flush water supplied by jet pump action so as to discharge waste have included, for example, the apparatus set forth in Patent Document 1 (Japanese Patent Unexamined Publication No. 2014-190065). In such apparatus, a portion or flush water supplied from a water supply source is stored, and a tank supplying flush water to the toilet main unit is installed on the top surface of the toilet main unit.

In recent years, with the increasing diversity of flush toilet design and greater water conservation, "low silhouette type" tanks have been employed, in which tanks are disposed at a relatively low position on the rear side of the toilet main unit so that the height position of the top edge of the tank can be set at a low position, minimizing the overall height of the flush toilet. In such low silhouette-type tanks, the connection between the tank and the toilet main unit may be made inside the tank if both a compact both front-to-back (depth) dimension and left-to-right (lateral) dimension are sought.

It is therefore possible to conceive of connecting the outlet of the tank and the inlet of the toilet main unit in a watertight manner from the interior of the tank, after first assembling the tank in a predetermined installation position relative to the toilet main unit. In such cases, if the center axis of the inlet of the toilet main unit and the center axis of the outlet of the tank are offset, the connecting pipe connecting the inlet of the toilet main unit and the outlet of the tank will be disposed at a diagonal, for example.

Hence when a tank is connected to a toilet main unit, the tank is disposed at a diagonal, resulting in the problem that the desired water level inside the tank cannot be attained, or the jet pump unit or related parts for inducing a jet pump action fail to operate correctly in response to the water level inside the tank.

As a result of the above, the flush water volume supplied to the toilet main unit from the tank is unstable, leading to the risk that flush performance will degrade, or water conservation performance will drop.

SUMMARY

The present invention was therefore undertaken to resolve the above-described problems with the conventional art, and has the object of providing a flush toilet capable of reducing the size of the overall apparatus while suppressing the decline in flushing performance and water conservation performance.

In order to accomplish the object above, the present invention is a flush toilet configured to discharge waste by flushing the flush toilet with flush water supplied by a jet pump action, the flush toilet comprising: a toilet main unit including a bowl configured to receive waste and a conduit configured to guide flush water to the bowl, the conduit including an inlet which is formed to open in a horizontal front-back direction of the toilet main unit; a tank assembled at a predetermined installation position behind the bowl of the toilet main unit, the tank being configured to store a portion of flush water supplied from a supply source and to supply flush water to the conduit in the toilet main unit; a seal member connected in a watertight manner to an outlet of the tank and the inlet of the conduit of the toilet main unit, respectively; and a connecting member configured to connect the tank to the toilet main unit in a watertight manner through the seal member with the connecting member which is inserted in the tank after the tank is assembled in the predetermined installation, wherein the connecting member includes a communicating pipe portion configured to communicate the conduit of the toilet main unit and an interior of the tank when one end of the connecting member is inserted from the interior of the tank through the outlet of the tank into the inlet of the conduit of the toilet main unit; wherein the tank includes a jet pump unit and a supply valve in the tank, at least part of the jet pump unit being submerged, and the supply valve being configured to supply and shut off flush water supplied from the supply source to the jet pump unit in response to a water level inside the tank; and wherein the jet pump unit includes a jet nozzle configured to jet flush water supplied from the supply source, and a throat pipe including a suction port at one end of the throat pipe and an outlet at other end of the throat pipe, the outlet of the throat pipe being connected to the communicating pipe portion; wherein the jet nozzle being configured to induce a jet pump action so as to increase a flow volume of flush water flowing in the throat pipe more than a flow volume of flush water jetted from the jet nozzle by jetting flush water from the suction port toward an interior of the throat pipe so that increased flow volume of flush water is supplied from the throat pipe toward the conduit of the toilet main unit; and the flush toilet further comprises a horizontal adjustment portion provided on the toilet main unit or the tank, the horizontal adjustment portion being configured to adjust an orientation of the tank to a horizontal state when the tank is assembled at the predetermined installation position.

According to the invention thus constituted, the horizontal adjustment portion configured to adjust the orientation of the tank to a horizontal state with the tank assembled at the predetermined set position behind the bowl of the toilet main unit, is placed on the toilet main unit or the tank. Thus even if the tank, while tilted, is assembled at the predetermined installation position behind the bowl in the toilet main unit, the orientation of the tank can be adjusted to the horizontal state by the horizontal adjustment portion.

Therefore with respect to the applied tank, for example, a tank with a relatively shallow depth inside the tank, and a low position for the top edge height position of the tank (a "low-silhouette tank") can be achieved, in which the front-back direction (depth) dimension and the left-right direction (lateral) dimension are compact.

Also, reductions in the amount of flush water inside the tank drawn in by the jet pump action of the jet pump unit inside the tank due to tilting of the tank and the water level inside it can be suppressed. Thus degradation of jet pump performance can be suppressed.

As a result, the amount of flush water supplied from the tank to the toilet main unit can be stabilized. Thus degradation of flushing performance can be suppressed, as can the decline in water conservation performance.

In the present invention, preferably, the horizontal adjustment portion includes a positioning member configured to position a communicating path in a segment of the communicating pipe portion from the outlet of the tank to the inlet of the conduit of the toilet main unit to the horizontal state.

According to the invention thus constituted, if under circumstances other than the present invention the center axis of the outlet of the tank and the center axis of the inlet of the conduit of the toilet main unit are offset, the vector of flush water flow will change in the flow path (for an example, the conduit of the toilet main unit etc.) on the downstream side of the communicating pipe portion of the connecting member. For this reason, there is a risk on the tank side as well that the amount of flush water in the tank drawn in by the jet pump action of the jet pump unit will decline, and jet pump performance will decline.

To counter this, the present invention includes a positioning member capable of adjusting the position of the communicating path in the communication pipe portion of the connecting member to a horizontal state from the outlet of the tank to the inlet of the conduit of the toilet main unit. By so doing, after the tank is assembled to the predetermined installation position on the toilet main unit, the communicating path in the communicating pipe portion of the connecting member can be easily positioned by the positioning member to the horizontal state in the segment from the outlet of the tank to the inlet of the conduit of the toilet main unit. Hence position matching of the center axis of the outlet of the tank and the center axis of the inlet of the conduit of the toilet main unit water conduit can be easily performed.

Therefore changes in the vector of the flow of flush water flowing from the communicating pipe portion of the connecting member to the conduit of the toilet main unit on the downstream side thereof can be suppressed. This makes it possible to suppress a reduction in the amount of flush water in the tank drawn in by the jet pump action of the jet pump unit and a drop in jet pump performance on the tank side as well.

In the present invention, preferably, the horizontal adjustment portion includes an operating portion interposed between the toilet main unit and the tank, the operating portion being configured to adjust a height position of the tank after the tank is assembled at the predetermined installation position behind the bowl of the toilet main unit.

According to the invention thus constituted if, for example, the need arises to fine-tune the tank height position, or fine tune the horizontal state of the orientation of the tank after the tank is assembled to the predetermined installation position, the operating portion of the horizontal adjustment portion can be operated without removing the tank from its predetermined installation position on the rear side of the conduit of the toilet main unit. Hence the height position of the tank relative to the toilet main unit can be easily fine-tuned, and the orientation of the tank can be fine-tuned to a horizontal state.

Therefore by maintaining the orientation of the tank in a horizontal state, the amount of flush water in the tank drawn in by the jet pump action of the jet pump unit can be suppressed from dropping. Hence, degradation of jet pump performance can be suppressed.

In the present invention, preferably, the seal member includes a tank outlet-side seal portion and a toilet main unit inlet-side seal portion, wherein the tank outlet-side seal portion is attached to the outlet of the tank, and the toilet main unit inlet-side seal portion is attached to the inlet of the toilet main unit with the tank being assembled at the predetermined installation position; and wherein the horizontal adjustment portion is configured to match positions among an center axis of the tank outlet-side seal portion, an center axis of the toilet main unit inlet-side seal portion, and an center axis of the communicating path in the communication pipe portion.

According to the invention thus constituted, sealing characteristics in the outlet of the tank, the inlet of the toilet main unit, etc. can be improved. Also, a more reliably watertight connection can also be made to the tank outlet-side seal portion, the toilet main unit inlet-side seal portion, and the communication pipe portion of the connecting member.

Using the flush toilet of the present invention, the apparatus as a whole can be reduced in size, and diminishment in flush performance and water conservation performance can be suppressed.

DETAILED DESCRIPTION

Below, referring to the attached drawings, a flush toilet according to an embodiment of the present invention is explained.

First, referring to FIGS. 1 through 4, the basic structure of a flush toilet according to an embodiment of the invention is explained.

Figure 1:
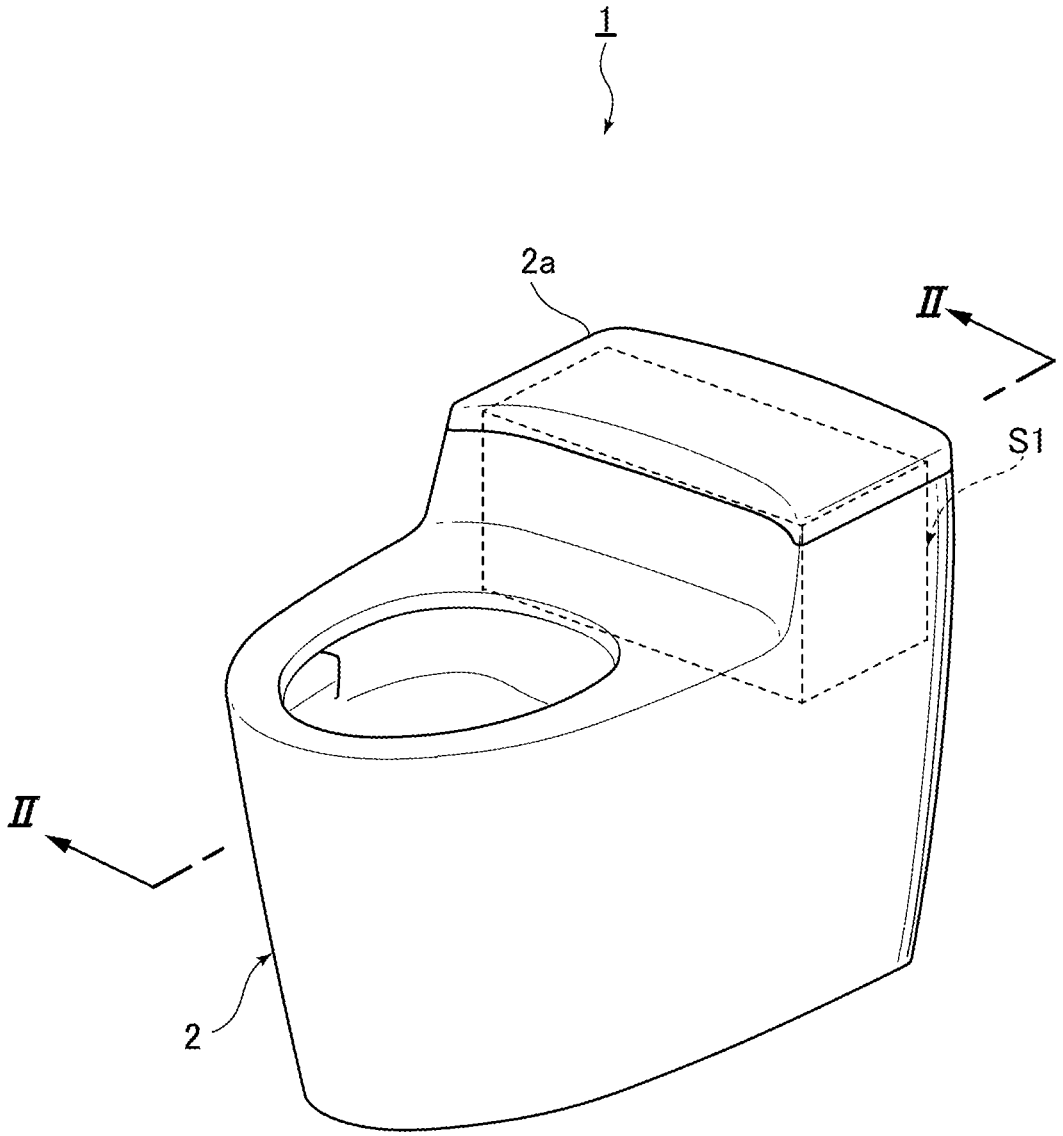
FIG. 1 is a simplified perspective view of a flush toilet according to an embodiment of the invention.
Figure 2:
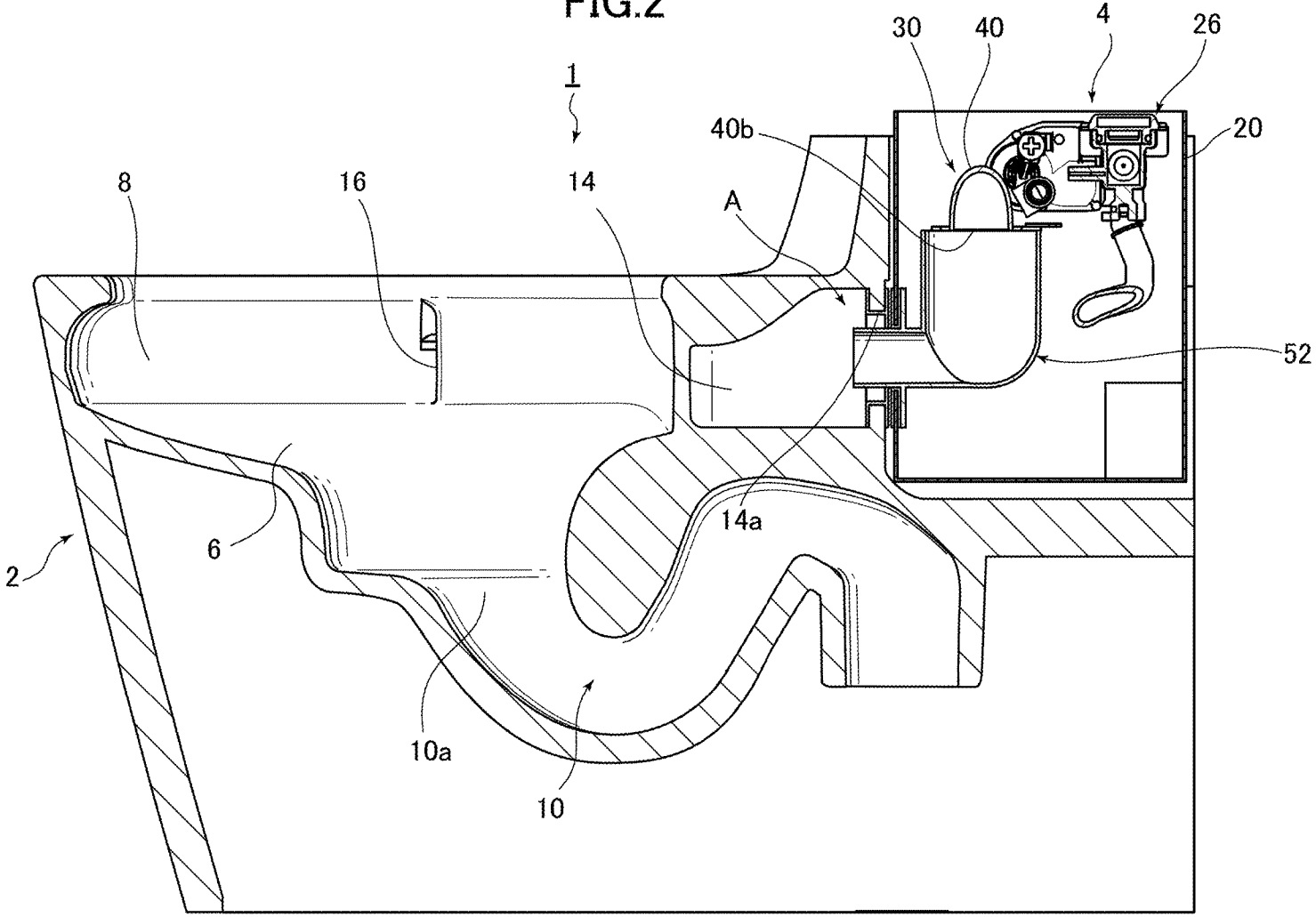
FIG. 2 is a center cross section along line II-II in FIG. 1.

FIG. 1 is a simplified perspective view of a flush toilet according to an embodiment of the invention; FIG. 2 is a center cross section along line II-II in FIG. 1.

First, as shown in FIGS. 1 and 2, the flush toilet 1 according to an embodiment of the invention is a water conserving "wash-down" type of flush toilet, flushing with 6.0 liters or less of flush water, for example, and preferably with 3.0 liters to 4.8 liters of flush water, and includes a ceramic toilet main body 2.

Also, as shown in FIGS. 1 and 2, the flush toilet 1 includes, with the tank cover 2*a* on the top edge at the rear side of the toilet main body 2 removed, a flush water tank apparatus 4 installed within a predetermined installation space S1 on the rear side of the toilet main body 2, and flush water is supplied to the toilet main body 2 by this flush water tank apparatus 4.

Next, as shown in FIG. 2, the toilet main body 2 includes a bowl 6, disposed on the front side thereof, for receiving waste, and a rim portion 8 formed on the top edge of this bowl 6.

An inlet 10*a* of a discharge trap pipe path 10 is opened at the bottom portion of the bowl 6 of the toilet main body 2; this discharge trap pipe path 10 extends from the inlet 10*a* diagonally downward and rearward, then extends to the peak portion diagonally upward and rearward, after which it extends downward and is connected to a discharge socket (not shown) disposed on the floor.

As shown in FIG. 2, a conduit 14 for conducting flush water supplied from the flush water tank apparatus 4 to the bowl 6 is formed on the rim portion 8 at the rear and sides of the bowl 6 of the toilet main body 2, and a spout port 16 from which flush water inside this conduit 14 is spouted is formed as a part of the bowl 6.

Note that in the flush toilet 1 according to an embodiment of the invention a wash-down form of toilet is explained in which waste is discharged by a drop in the height direction, but what is known as a siphon toilet, wherein waste is drawn into the bowl 6 using a siphon action and discharged all at once from the discharge trap pipe path 10, or forms other than these, may also be applied.

Also, in the flush toilet 1 according to the present embodiment, wastewater discharged from the discharge trap pipe path 10 is made to discharge to an under-floor waste conduit (not shown), but a discharge socket (not shown) form may also be adopted, as may a form in which wastewater discharged from the discharge trap pipe path 10 is discharged to a discharge conduit (not shown) on the rear side of the flush toilet 1.

Next, referring to FIGS. 1 through 9, details of the flush water tank apparatus 4 are explained.

Figure 3:
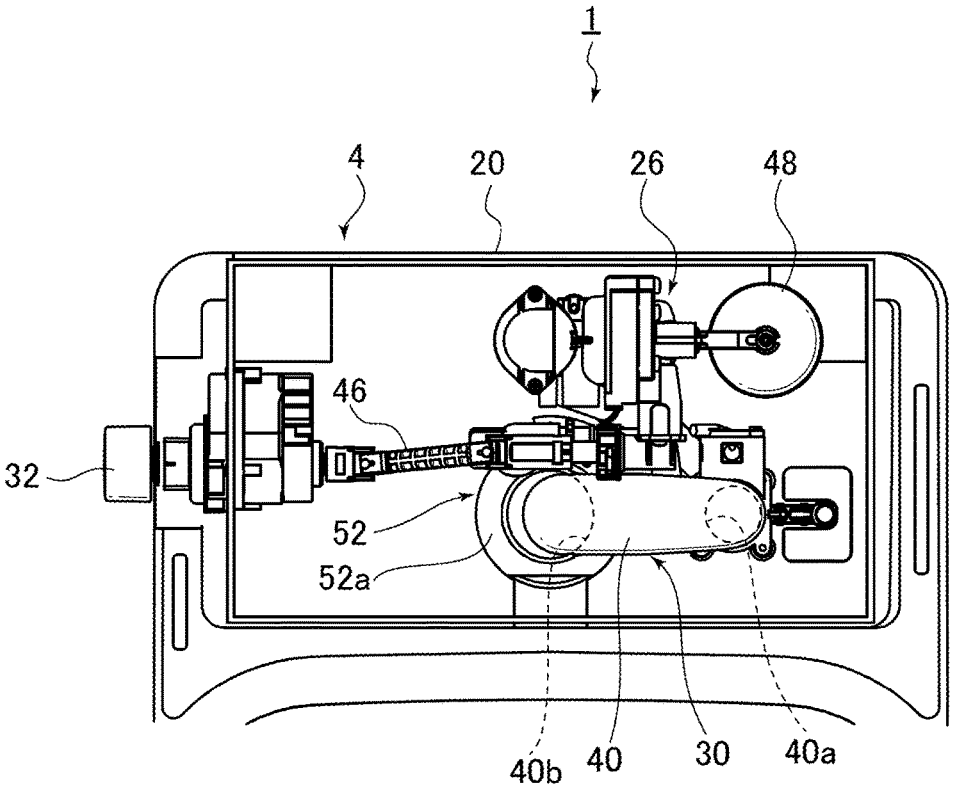
FIG. 3 is a plan view showing the internal structure of a flush water tank apparatus in a flush toilet according to an embodiment of the present invention.
Figure 4:
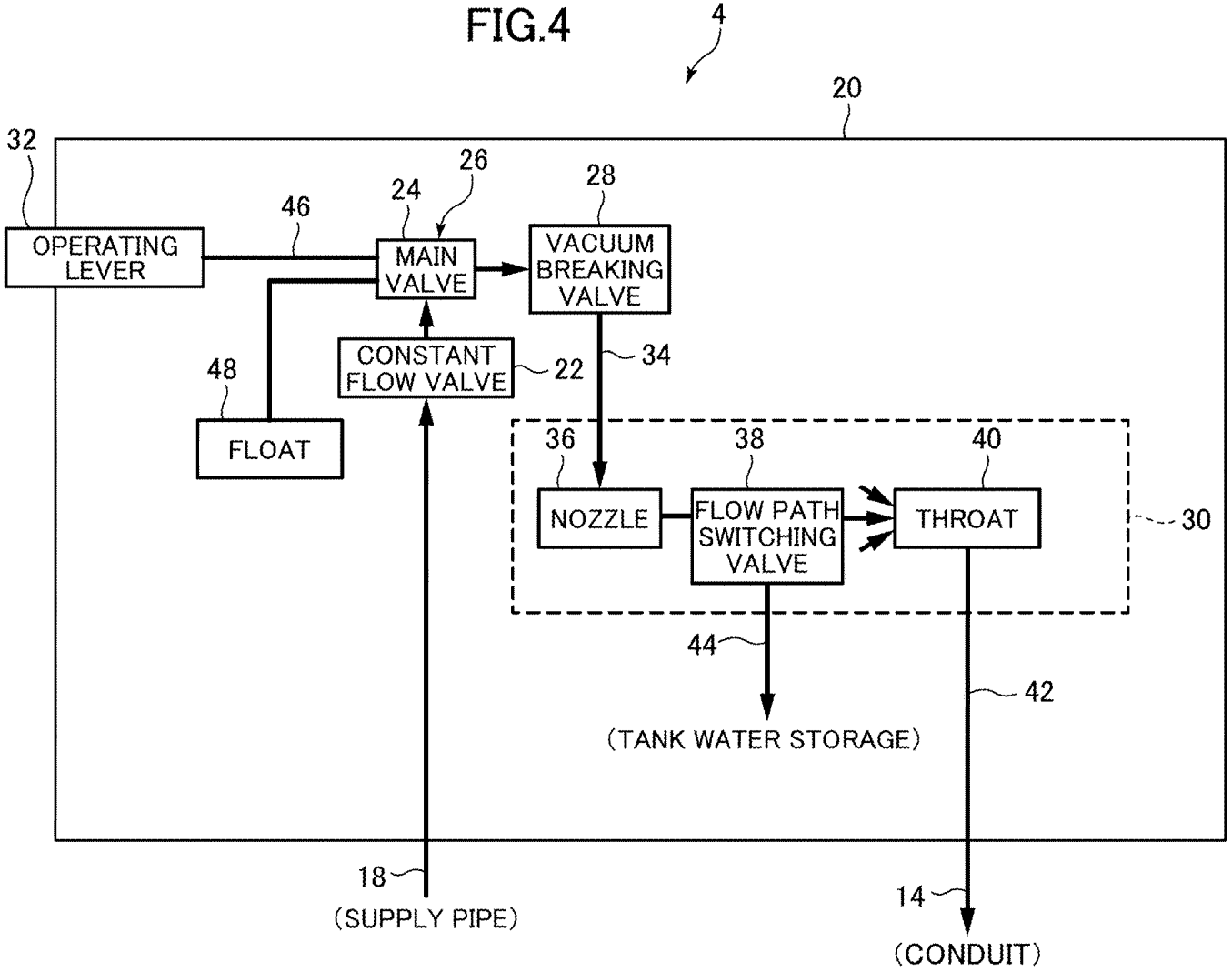
FIG. 4 is a block diagram showing the basic constitution of a flush water tank apparatus in a flush toilet according to an embodiment of the present invention.

FIG. 3 is a plan view showing the internal structure of a flush water tank apparatus in a flush toilet according to an embodiment of the invention; FIG. 4 is a block diagram showing the basic constitution of a flush water tank apparatus in a flush toilet according to an embodiment of the invention.

The left and right directions of the flush water tank apparatus 4 shown in FIG. 3 are defined such that the left direction as seen in the left-right direction from the front side of the toilet main body 2 is the "left side," and the right side in the left-right symmetrical as seen from the front side of the toilet main body 2 is the "right side."

As shown in FIGS. 1 through 4, the flush water tank apparatus 4 includes: a supply pipe 18 connected on its upstream side to a municipal water supply source (not shown), and a reservoir tank 20 installed in a predetermined installation space S1 to the rear of the bowl 6 of the toilet main body 2, wherein a portion of the flush water supplied from the water supply source (not shown) through the supply pipe 18 is stored, and serving as a tank for supplying flush water to the conduit 14 of the toilet main body 2.

Further, the reservoir tank 20, as shown in FIG. 3, is formed in a long, flat shape in the left-right direction as seen in plan view and, as shown in FIG. 2, is disposed at a relatively low position on the rear side of the toilet main body 2, and is what is known as a low-silhouette-type of reservoir tank, wherein the height position of the top edge of the reservoir tank 20 is low.

Next, as shown in FIGS. 2 through 4, a supply valve apparatus 26 including a main valve 24 is internally installed inside the reservoir tank 20 as a supply valve for supplying and shutting off the flush water supplied from the supply pipe 18 through a constant flow valve 22, and a jet pump unit 30 (described in detail below), connected through a vacuum breaking valve 28, is internally installed on the downstream side of the supply valve apparatus 26 inside the reservoir tank 20.

Also, as shown in FIGS. 2-4, the flush water tank apparatus 4 includes an operating lever 32, placed on the left side portion of the reservoir tank 20 as seen from the front side of the toilet main body 2, for controlling the operation of the supply valve apparatus 26.

Next, as shown in FIGS. 2-4, the jet pump unit 30 is disposed so that at least a portion is submerged inside the reservoir tank 20, and includes a jet nozzle 36 for jetting flush water supplied from a supply pipe 34 extending from the vacuum breaking valve 28. Here the vacuum breaking valve 28 draws in air from outside and functions to prevent a negative pressure from occurring inside the supply pipe 34 from the vacuum breaking valve 28 to the jet nozzle 36.

As shown in FIG. 4, the jet pump unit 30 includes a flow path switching valve 38 disposed close to the downstream side of the jet nozzle 36, for switching the flow path of flush water jetted from the jet nozzle 36 in response to the water level inside the reservoir tank 20.

In addition, as shown in FIGS. 2-4, the jet pump unit 30 includes a throat pipe 40, at one end of which a suction port 40*a* is formed, and at the other end of which an outlet 40*b* is formed. The pipe shape of the throat pipe 40 from the suction port 40*a* to the outlet 40*b* thereof may be formed as a reverse U, for example (or, worded differently, as a reverse J, or a gooseneck).

The jet nozzle 36 is disposed so as to oppose the suction port 40*a* of the throat pipe 40; this suction port 40*a* of the throat pipe 40 and jet nozzle 36 are constantly submerged inside the reservoir tank 20.

As shown in FIGS. 2-4, when the bowl 6 of the toilet main body 2 is flushed, the flow path switching valve 38 causes flush water jetted from the jet nozzle 36 to flow from the suction port 40*a* of the throat pipe 40 into the throat pipe 40.

The flow path switching valve 38 is capable of switching to the toilet flushing flow path 42 carrying an outflow from the outlet 40*b* to the conduit 14 side of the toilet main body 2, based on the water level inside the reservoir tank 20.

In addition, when water is being stored in the reservoir tank 20, the flow path switching valve 38 also switches to the tank water storage flow path 44, which directs flush water jetted from the jet nozzle 36 to the interior of the reservoir tank 20 on the outside of the throat pipe 40 so that it does not flow into the throat pipe 40.

By the above means, when the flow path switching valve 38 is installed on the toilet flushing flow path 42, the jet nozzle 36 jets flush water from the suction port 40*a* of the throat pipe 40 toward the interior. It also induces a jet pump action to increase the flow volume of flush water flowing in the throat pipe 40 to be greater than the flow volume of flush water jetted from the jet nozzle 36. The increased flow volume of flush water is thus supplied from the outlet 40*b* of the throat pipe 40 toward the conduit 14 of the toilet main body 2.

I.e., the term "jet pump action" set forth in this Specification means that a powerful flow of flush water jetted from the jet nozzle 36 toward the suction port 40*a* of the throat pipe 40 itself forms a negative pressure, drawing in the flush water around the suction port 40*a* of the throat pipe 40 without depending on a pump or other mechanical means. It also means the action by which flush water in the reservoir tank 20, drawn into the throat pipe 40 using this negative pressure, is conveyed to the toilet main body 2 side.

Here, as shown in FIGS. 2-6, the structure, action mechanism, and the like of the supply valve apparatus 26 are the same as in conventional apparatuses, so a specific explanation thereof is here omitted.

Note that the main valve 24 is a pilot-type diaphragm valve; it is connected by a drive shaft 46 to an operating lever 32, and can be opened and closed by the operation of a first pilot valve (not shown), which is opened and closed by this operating lever 32. At the same time, it can be opened and closed by the operation of a second pilot valve (not shown), which is opened and closed by the rise and fall of the valve member 48, which rises and falls with the flush water level in the supply valve apparatus 26.

Figure 5:
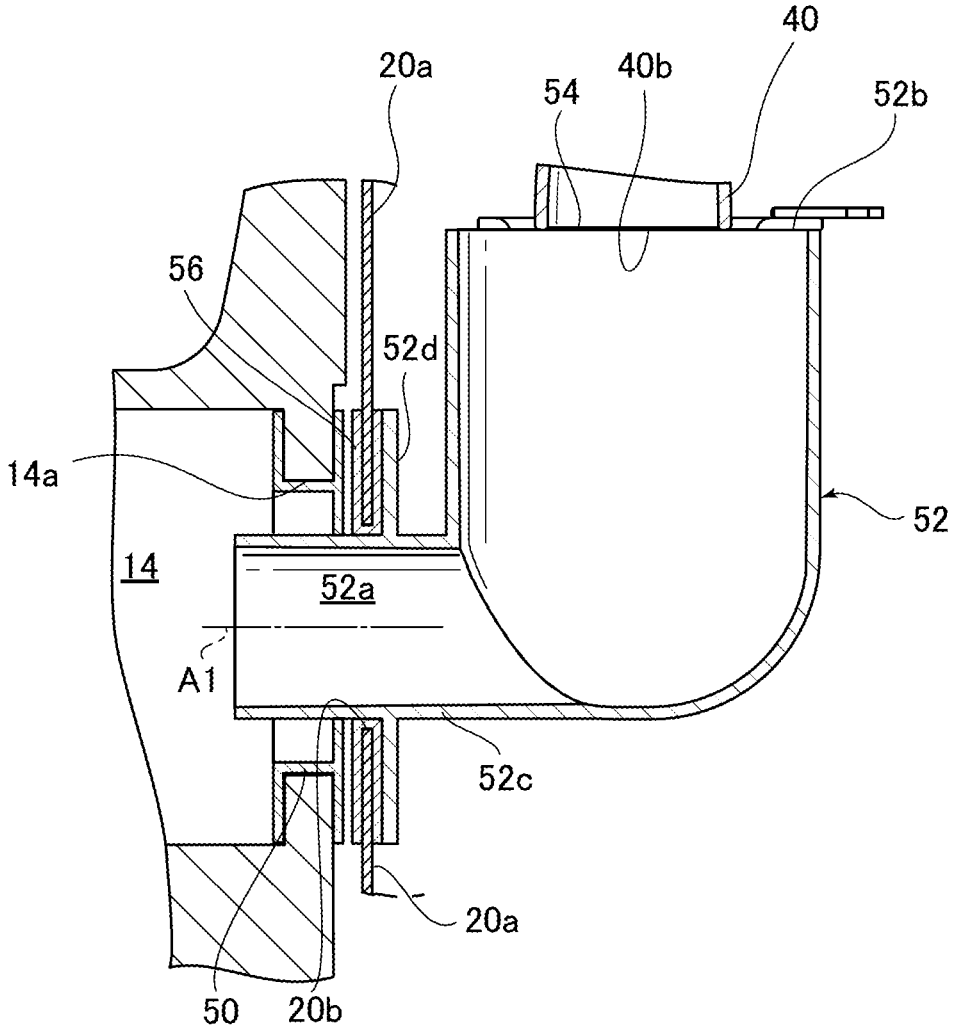
FIG. 5 is an expanded view of part A in FIG. 2.

Next, FIG. 5 is an expanded view of the part A in FIG. 2.

As shown in FIG. 2 and FIGS. 3-5, a packing 50, being a seal member on the toilet main unit inlet side, is sealed in a watertight manner to the inlet 14*a* on the rear side of the conduit 14 of the toilet main body 2. One end of a connecting pipe member 52 is inserted from the rear side of this packing 50 and connected thereto in a watertight manner.

Also, as shown in FIG. 2 and FIGS. 3-5, the connecting pipe member 52 forms a connecting pipe path 52*a* extending essentially horizontally from one end portion (the front end portion) connected in a watertight manner to the packing 50, then bending the top side thereof.

Meanwhile, as shown in FIG. 2 and FIG. 3-5, a throat pipe-side connecting portion 54 forming the outlet 40*b* of the throat pipe 40 is formed on the other end portion (top end portion 52*b*) of the connecting pipe member 52.

Here, after the reservoir tank 20 is assembled into a predetermined installation space S1 on the rear side of the toilet main body 2, the connecting pipe member 52, inserted into the reservoir tank 20, can connect the conduit 14 of the toilet main body 2 and the reservoir tank 20 in a watertight manner.

As shown in FIG. 5, the connecting pipe member 52 includes a communicating pipe portion 52*c*. One end (the front end portion) of this communicating pipe portion 52*c* is inserted from inside the reservoir tank 20, through the outlet 20*b* in the front wall portion 20*a* of the reservoir tank 20, into the inlet 14*a* on the conduit 14 of the toilet main body 2. With the front end portion of this communicating pipe portion 52*c* inserted into the inlet 14*a*, communication is enabled between the inlet 14*a* of the conduit 14 of the toilet main body 2 and the outlet 40*b* of the throat pipe 40.

In addition, as shown in FIG. 5, a packing 56, being the tank main unit outlet-side seal portion of the seal member, is disposed in a watertight manner on the outlet 20*b* of the reservoir tank 20. Thus the communicating pipe portion 52*c* of the connecting pipe member 52 is inserted from the rear side on the inside of this packing 56 and connected in a watertight manner. At the same time, a flange portion 52*d*, projecting radially outward from the outer circumferential surface of the communicating pipe portion 52*c* of the connecting pipe member 52, is tightly adhered to the rear surface side of the packing 56. This results in a watertight connection between the communicating pipe portion 52*c* of the connecting pipe member 52 and the outlet 20*b* of the reservoir tank 20. Therefore flush water in the reservoir tank 20 does not leak out from the outlet 20*b*.

Note also that in the state before the reservoir tank 20 is assembled into the predetermined installation space S1, the supply valve apparatus 26 inside the reservoir tank 20, the jet pump unit 30, and related internal parts etc. are not attached inside the reservoir tank 20. After the reservoir tank 20 is assembled into the predetermined installation space S1, the connecting pipe member 52 is inserted into the reservoir tank 20. Thereafter, the connecting pipe member 52 is attached into the reservoir tank 20 with the inlet 14*a* of the conduit 14 of the toilet main body 2 and the outlet 20*b* of the reservoir tank 20 attached by the communicating pipe portion 52*c* of the connecting pipe member 52.

Note that in the present embodiment a form is explained in which packings 50 and 56 were employed as the seal material to connect in a watertight manner the communicating pipe portion 52*c* of the connecting pipe member 52 to the inlet 14*a* of the conduit 14 of the toilet main body 2 and the outlet 20*b* of the reservoir tank 20. However a seal member other than packing may also be used. I.e. any seal member is acceptable so long as it connects the communicating pipe portion 52*c* of the connecting pipe member 52 to the inlet 14*a* of the conduit 14 of the toilet main body 2 and the outlet 20*b* of the reservoir tank 20 in a watertight manner.

Regarding the packing 50 which is part of the seal portion on the toilet main unit inlet side, and the packing 56 which is part of the seal portion on the tank main unit outlet side in the present embodiment, these are mutually separate members. However, the two members 50 and 56 may also be formed as a single unit.

Figure 6:
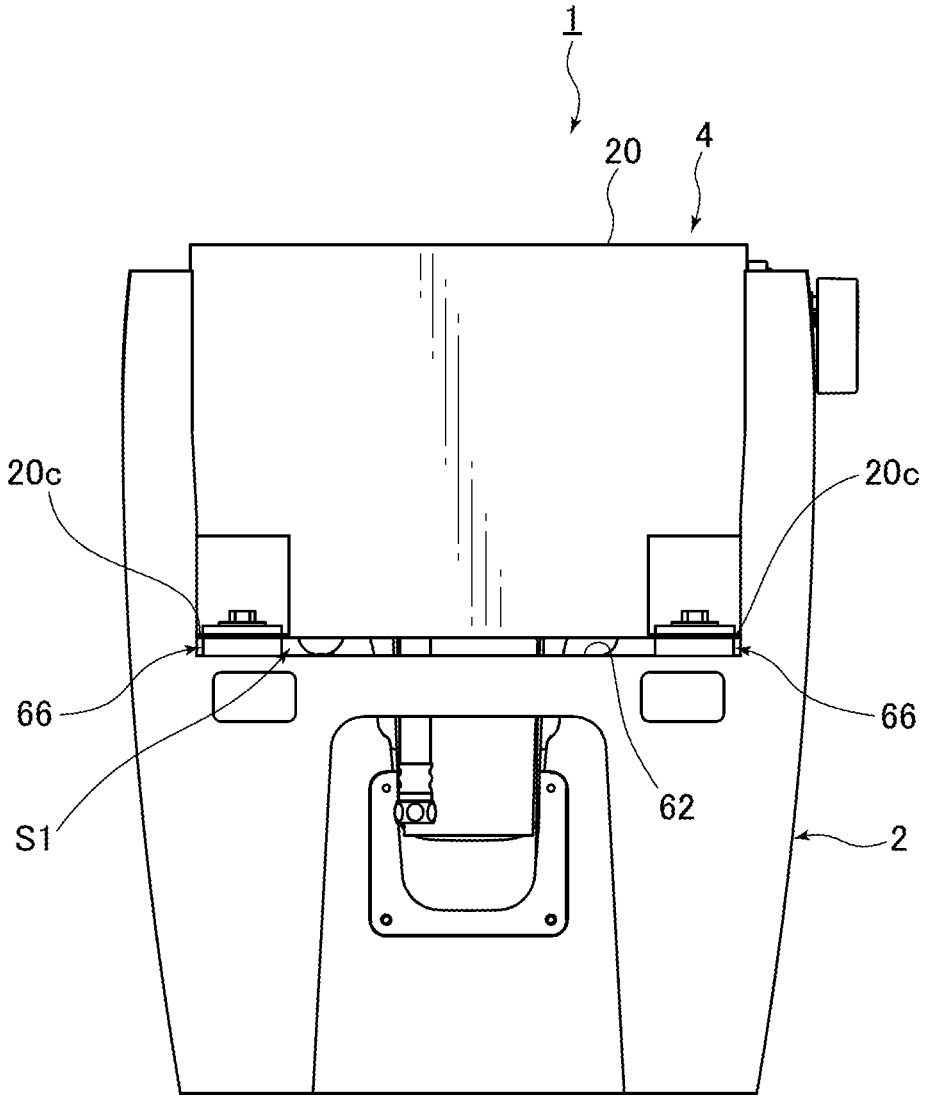
FIG. 6 is a rear elevation view of a flush toilet according to an embodiment of the invention.

Next, FIG. 6 is a rear elevation view of a flush toilet according to an embodiment of the invention.

As shown in FIG. 6, the flush toilet 1 of the present embodiment includes a pair of affixing devices 66, being a horizontal adjustment portion capable of adjusting the orientation of the reservoir tank 20 to a horizontal state. With the flush water tank apparatus 4 reservoir tank 20 installed in a predetermined installation space S1, the base portion 20*c* at the back surface and left and right sides of the reservoir tank 20 can be adjusted.

Note that in the present embodiment the affixing devices 66 also include an affixing function for affixing the reservoir tank 20 to the toilet main body 2. However, the may also include an affixing means, separate from the horizontal adjusting portion, with an affixing function for affixing the reservoir tank 20 to the toilet main body 2.

Figure 7:
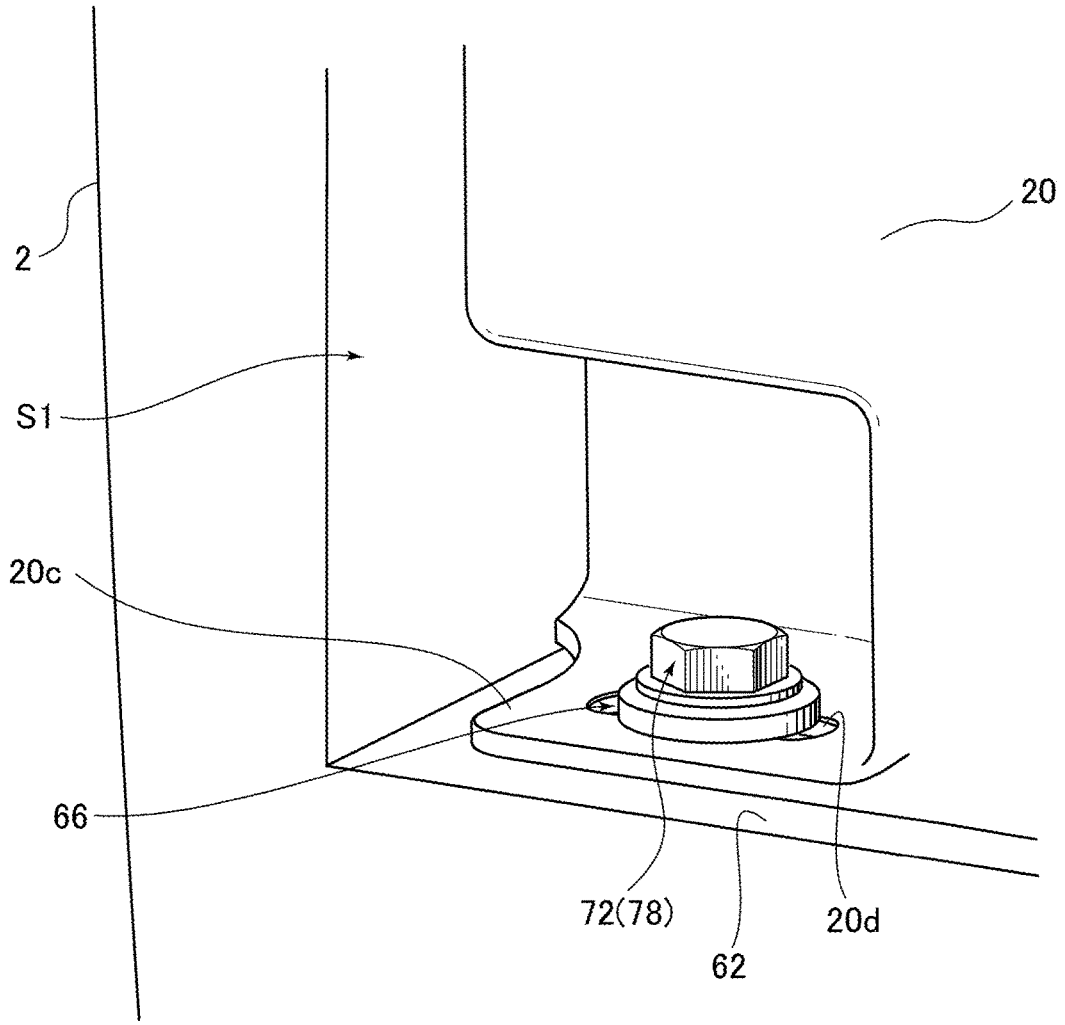
FIG. 7 is a simplified expanded perspective view of an affixing device for affixing the reservoir tank of the flush water tank apparatus to a toilet main unit in a flush toilet according to the embodiment of the present invention shown in FIG. 6.
Figure 8:
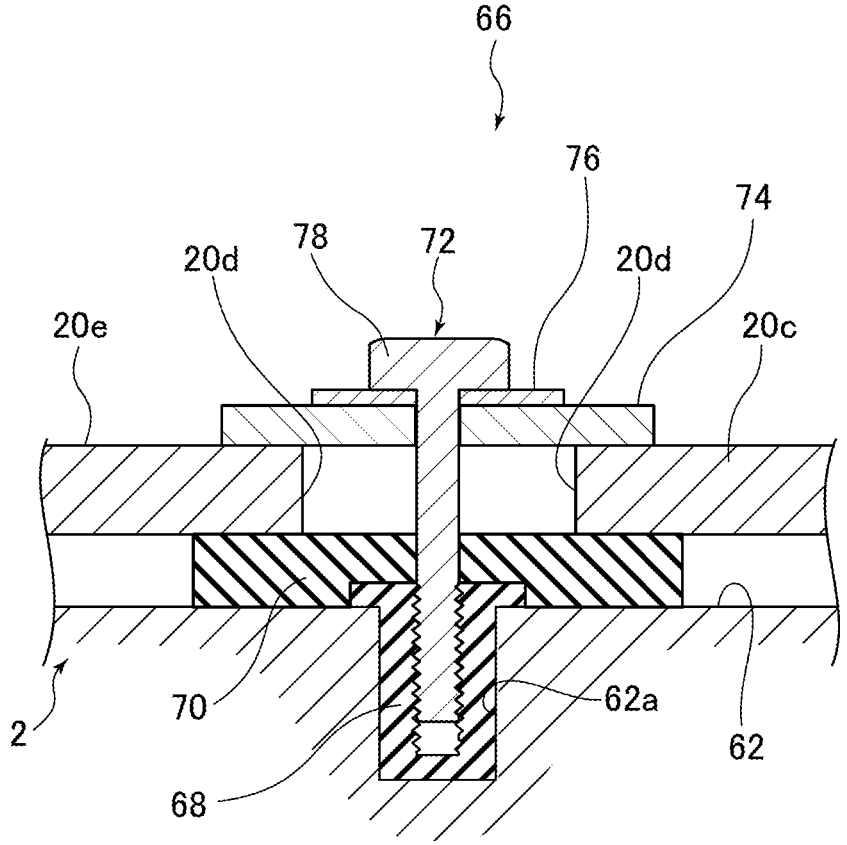
FIG. 8 is a simplified view of an affixing device for affixing the reservoir tank of the flush water tank apparatus to a toilet main unit in a flush toilet according to an embodiment of the present invention.

Next, FIG. 7 is a simplified expanded perspective view of an affixing device for affixing the reservoir tank of the flush water tank apparatus to the toilet main unit in a flush toilet according to the embodiment of the present invention shown in FIG. 6. FIG. 8 is a simplified view of an affixing device for affixing the reservoir tank of the flush water tank apparatus to the toilet main unit in the flush toilet according to an embodiment of the present invention.

As shown in FIGS. 7 and 8, the affixing device 66 includes a rubber bushing 68, a flexible member 70, a metal washer 74, and a spring washer 76.

The rubber bushing 68 is inserted and attached in the attaching hole 62*a* of the bottom surface 62 in the installation space S1 on the toilet main body 2 reservoir tank 20.

The flexible member 70 includes a cushion or the like, disposed inside the tank-affixing long hole 20*d* which penetrates in the up and down direction of the base portion 20*c* of the reservoir tank 20.

The bolt 72 is attached to the rubber bushing 68 through the flexible member 70.

The metal washer 74 is attached to this bolt 72 and the bottom surface thereof can contact the 20 bottom surface 20*e* of the reservoir tank 20.

The spring washer 76 is attached to the bolt 72 and the bottom surface thereof can contact the top surface of the metal washer 74.

A bolt operating portion 78 is integrally formed at the head portion (top end portion) of the bolt 72. The bottom surface of this bolt operating portion 78 can contact the top surface of the spring washer 76, and is formed to project radially outward.

In addition, the rubber bushing 68 also functions as a nut engaged by the lower part of the bolt 72.

These elements 68, 70, 72, 74, 76, and 78 function as a horizontal adjustment portion capable of adjusting the orientation of the reservoir tank 20 to a horizontal state. Of these horizontal adjustment portions, the flexible member 70 in particular functions as a positioning member capable of positioning the connecting pipe path 52*a* in the communicating pipe portion 52*c* of the connecting pipe member 52 in a horizontal state in the segment from the outlet 20*b* of the reservoir tank 20 to the inlet 14*a* of the conduit 14.

Note that in the present embodiment an example is explained in which the flexible member 70 functions as a positioning member capable of positioning the connecting pipe path 52*a* in the communicating pipe portion 52*c* of the connecting pipe member 52 in a horizontal state in the segment from the outlet 20*b* of the reservoir tank 20 to the inlet 14*a* of the conduit 14. It is also possible, however, to adopt positioning members with other structures different from the flexible member 70, such as spacers or the like.

In the present embodiment, the form is also explained in which the rubber bushing 68 and the flexible member 70 are mutually separate members. However, the two members 68 and 70 may also be mutually formed as a single unit.

First, as shown in FIG. 5 and FIGS. 7 and 8, after the reservoir tank 20 is assembled into the predetermined installation space S1, the connecting pipe member 52 is inserted into the reservoir tank 20. Thereafter, the inlet 14*a* of the conduit 14 of the toilet main body 2 and the outlet 20*b* of the reservoir tank 20 are connected by the communicating pipe portion 52*c* of the connecting pipe member 52. When connected in this way, with respect in particular to the rubber bushing 68 and flexible member 70, etc. which are part of the horizontal adjustment portion, mutual positioning can be achieved among the center axis A1 of the packing 56 at the outlet 20*b* of the reservoir tank 20, the center axis A2 of the packing 50 at the inlet 14*a* of the toilet main body 2, and the center axis A3 of the connecting pipe path 52*a* in the communicating pipe portion 52*c* of the connecting pipe member 52. By this means the rubber bushing 68 and flexible member 70, etc. are able to elastically deform so that the communicating path (the connecting pipe path 52*a*) in the segment from the outlet 20*b* of the reservoir tank 20 to the inlet 14*a* of the conduit 14 of the toilet main body 2 can be positioned to a horizontal state.

More specifically, as shown in FIGS. 6-8, in the affixing devices 66, after the reservoir tank 20 is assembled at a predetermined installation position on the rear side of the toilet main body 2, the bolt operating portion 78, which is the operating portion of the horizontal adjustment portion, functions as an operating portion capable of a tightening operation. By this means, the amount of elastic deformation occurring when the flexible member 70 is compressed in the axial direction can be adjusted in response to the degree of tightening of this bolt operating portion 78. The height position of the reservoir tank 20 relative to the toilet main body 2 can thus be adjusted.

Therefore after the reservoir tank 20 has been assembled at a predetermined installation position on the rear side of the toilet main body 2, and is affixed to the toilet main body 2 by the affixing devices 66, if the need arises to fine-tune the height position of the reservoir tank 20 or fine-tune the horizontal orientation of the reservoir tank 20, for example, the degree of tightening of the bolt operating portion 78 can be adjusted without removing the reservoir tank 20 from its predetermined installation position on the rear side of the toilet main body 2. The height position of the reservoir tank 20 can thus be easily fine-tuned simply by adjusting the degree of deformation of the flexible member 70 or the degree of tightening between the toilet main body 2 and the reservoir tank 20 by the affixing devices 66. Therefore the orientation of the reservoir tank 20 can be easily fine-tuned to a horizontal state.

Also, as shown in FIG. 8, on the base portion 20*c* of the reservoir tank 20, the size of the long hole 20*d* for affixing the tank is set to be somewhat larger than the outside diameter of the bolt 72 or the flexible member 70 so that the long hole 20*d* functions as an adjustment hole. Therefore even if there is some degree of dimensional error in the reservoir tank 20 or the ceramic toilet main unit, the reservoir tank 20 can be moved within the range of the long hole 20*d* to fine-tune its position. This enables dimensional errors to be absorbed.

Figure 9:
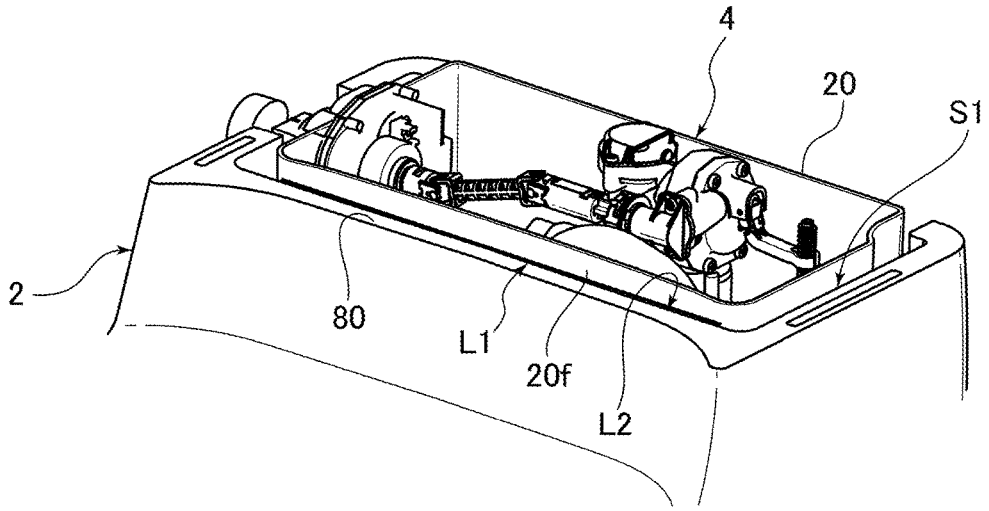
FIG. 9 is a perspective view showing the state occurring when a connection state is confirmed between a toilet main unit and a reservoir tank in a flush toilet according to an embodiment of the invention.

Next, FIG. 9 is a perspective view showing the state occurring when a connection state is confirmed between a toilet main unit and a reservoir tank in a flush toilet according to an embodiment of the invention.

As shown in FIG. 9, a push-in depth confirmation line L1 extending in the horizontal left-right direction is disposed on the external side front surface 20*f* of the reservoir tank 20 as a means for confirming the reservoir tank 20 connection state.

At the same time, the line L2 extending in the horizontal left-right direction of the front side top edge portion 80 of the installation space S1 in the reservoir tank 20 on the rear side of the toilet main body 2 is also a toilet main unit-side confirmation line L2 for confirming if there is a match with the reservoir tank 20 push-in depth confirmation line L1. This confirmation line L2 also functions as a means for confirming the connection state of the reservoir tank 20 relative to the toilet main body 2.

Here, in the reservoir tank 20 shown in FIG. 9, the reservoir tank 20 is assembled into the predetermined installation space S1 on the rear side of the toilet main body 2.

Thereafter, before the tank cover 2*a* is attached to the top end portion of the installation space S1 of the reservoir tank 20 on the rear side of the toilet main body 2, the push-in depth confirmation line L1 is parallel to the toilet main unit-side confirmation line L2. At the same time, it essentially matches the height positions of both L1 and L2, and the reservoir tank 20 is correctly installed at the predetermined installation position on the rear side of the toilet main body 2.

Next, referring to FIGS. 1-11B, a method for installing a flush water tank apparatus 4 on a flush toilet 1 according to an embodiment of the invention at the predetermined installation position on the toilet main body 2, and the action of the flush toilet 1 according to an embodiment of the invention are explained.

Figure 10A:
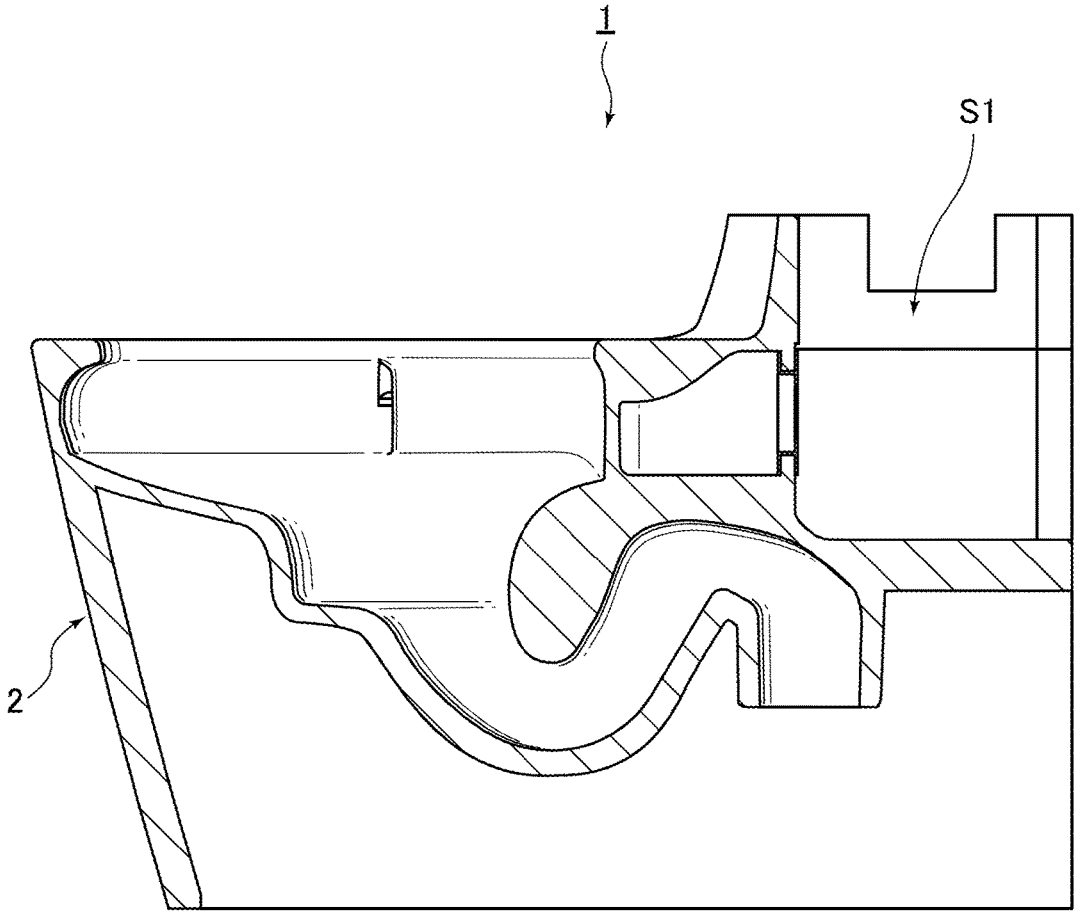
FIG. 10A is a simplified cross section showing the state prior to start of installation, when the reservoir tank of the flush water tank apparatus is assembled at a predetermined installation position on the rear side of the toilet main unit in a flush tank apparatus according to an embodiment of the invention.

First, FIG. 10A is a simplified cross section showing the state prior to start of installation, when the reservoir tank of the flush water tank apparatus is assembled at a predetermined installation position on the rear side of the toilet main unit in a flush tank apparatus according to an embodiment of the invention.

Figure 10B:
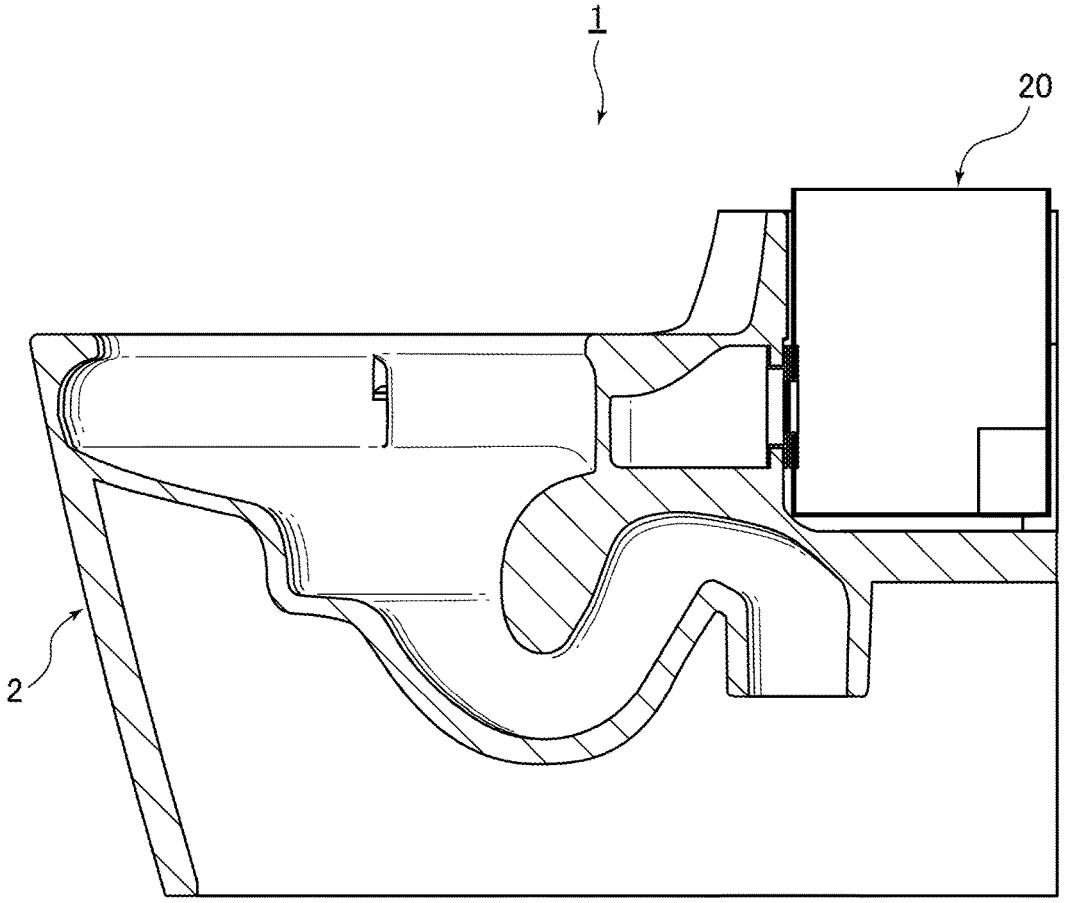
FIG. 10B is a simplified cross section showing a first installation state in which, after the pre-installation start state shown in FIG. 10A, only a reservoir tank, in which the internal parts of the flush water tank apparatus of the flush toilet according to an embodiment of the invention are not internally installed, is assembled to a predetermined installation position on the rear side of the toilet main unit.

Next, FIG. 10B is a simplified cross section showing a first installation state in which, after the pre-installation start state shown in FIG. 10A, only a reservoir tank, in which no internal parts of the flush water tank apparatus of the flush toilet according to an embodiment of the invention are internally installed, is assembled at a predetermined installation position on the rear side of the toilet main unit.

Figure 10C:
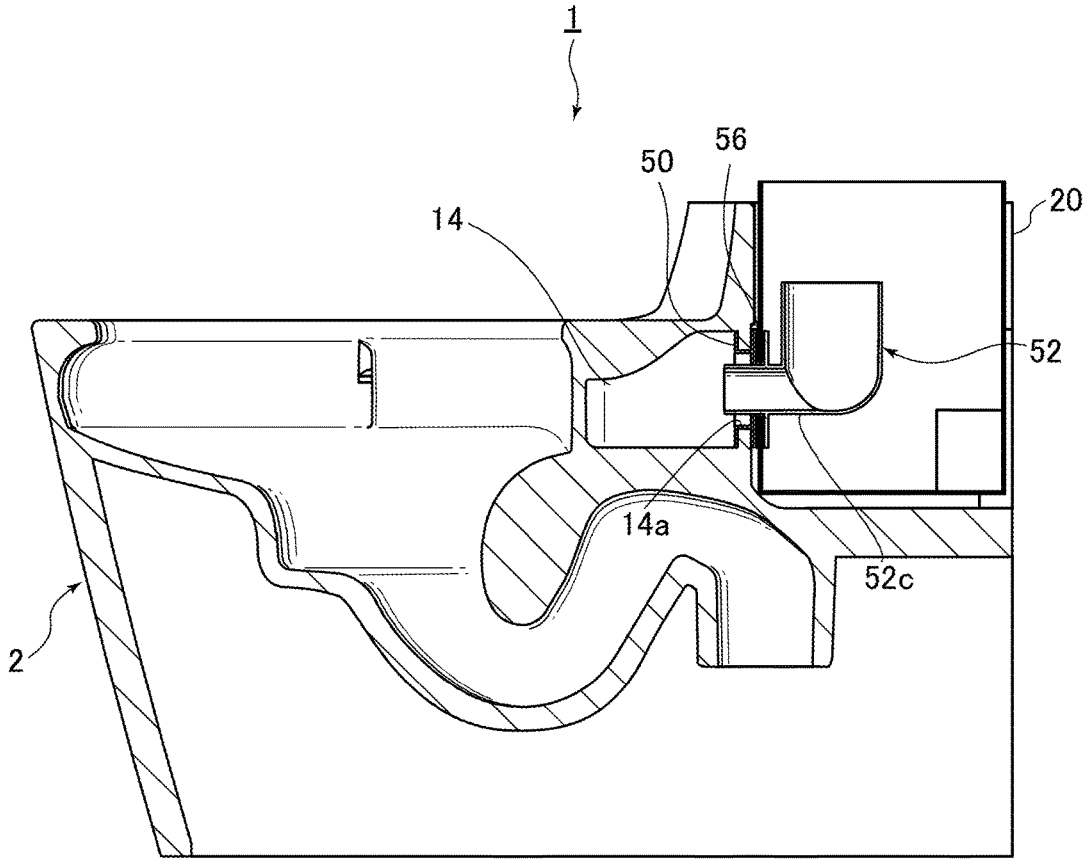
FIG. 10C is a simplified cross section showing a second installation state in which, after the first installation state shown in FIG. 10B, the connecting pipe member on the flush water tank apparatus of the flush toilet according to a first embodiment of the invention is connected in a watertight manner through packing to the outlet of the reservoir tank and the inlet of the conduit of the toilet main unit, respectively, after insertion into the reservoir tank.

FIG. 10C is a simplified cross section showing a second installation state in which, after the first installation state shown in FIG. 10B, the connecting pipe member on the flush water tank apparatus of the flush toilet according to a first embodiment of the invention is connected in a watertight manner through packing to the outlet of the reservoir tank and the inlet of the conduit of the toilet main unit, respectively, after insertion into the reservoir tank.

Figure 10D:
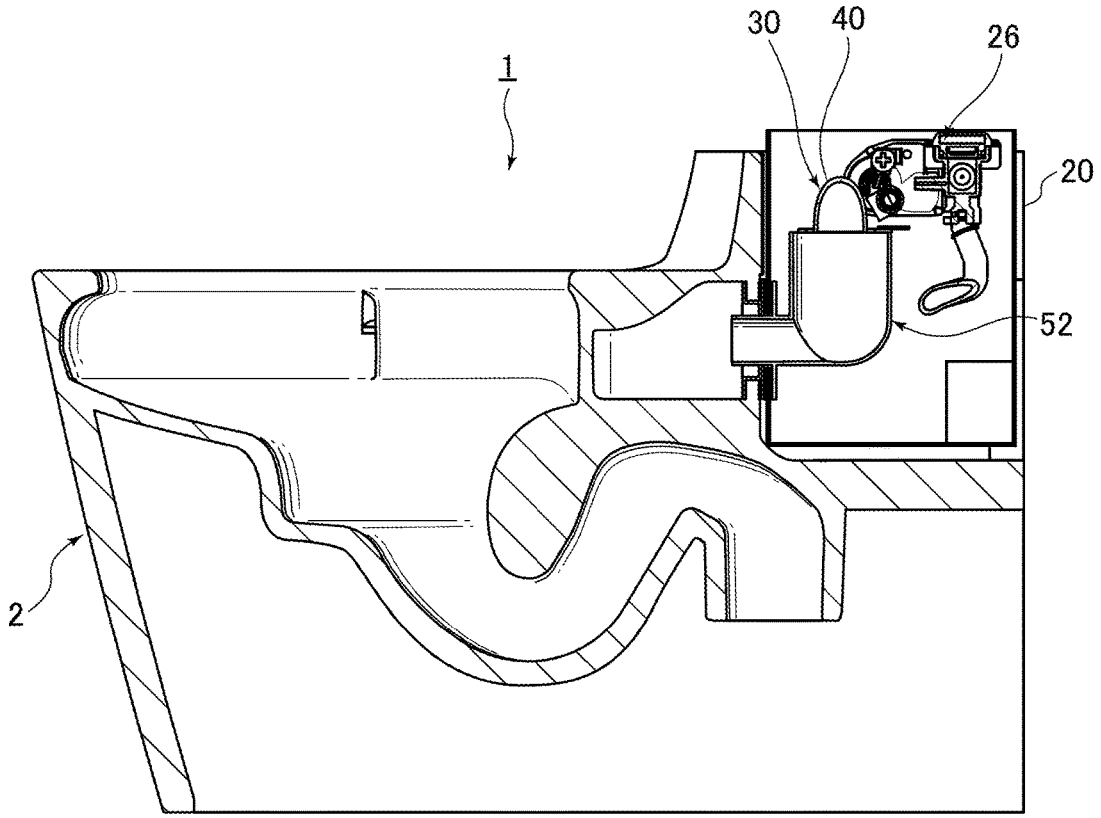
FIG. 10D is a simplified cross section showing a third installation state in which, after the second installation state shown in FIG. 10C, internal parts of the flush water tank apparatus in a flush toilet according to a first embodiment of the invention are internally placed in the reservoir tank, and a portion thereof are connected to a connecting pipe member.

In addition, FIG. 10D is a simplified cross section showing a third installation state in which, after the second installation state shown in FIG. 10C, internal parts of the flush water tank apparatus in a flush toilet according to a first embodiment of the invention are installed in the reservoir tank, and a portion thereof are connected to a connecting pipe member.

Figure 11A:
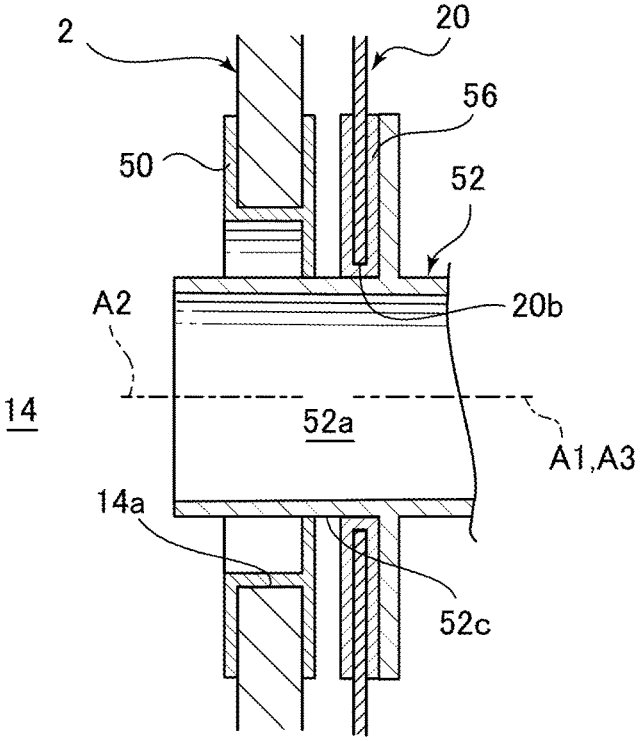
FIG. 11A is a summary diagram showing that, in a flush toilet according to an embodiment of the invention, because the center axis of the outlet of the reservoir tank and the center axis of the inlet of the conduit of the toilet main unit are positioned to correctly align with one another when the reservoir tank is assembled into a predetermined installation position, the communicating pipe portion of the connecting pipe member in the segment from the outlet of the reservoir tank to the inlet of the conduit of the toilet main unit is connected so as to be correctly sealed in a watertight manner in a horizontal state.

FIG. 11A is a summary diagram showing that, in a flush toilet according to an embodiment of the invention, because the center axis of the outlet of the reservoir tank and the center axis of the inlet of the conduit of the toilet main unit are positioned to correctly align with one another when the reservoir tank is assembled into a predetermined installation position, the communicating pipe portion of the connecting pipe member in the segment from the outlet of the reservoir tank to the inlet of the conduit of the toilet main unit are connected so as to be correctly sealed in a watertight manner in a horizontal state.

Figure 11B:
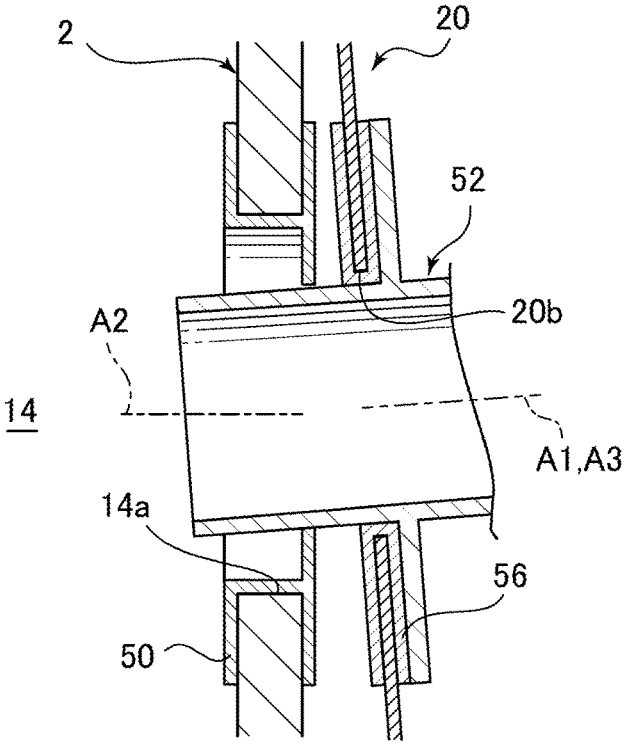
FIG. 11B is a summary diagram showing, as a comparative example to the flush toilet according to the first embodiment of the invention shown in FIG. 11A, that because the reservoir tank orientation is tilted when the reservoir tank is assembled to a predetermined installation position, and the center axis of the outlet of the reservoir tank and the center axis of the inlet of the conduit of the toilet main unit are mutually offset, the communicating pipe portion of the connecting member in the segment from the outlet of the reservoir tank to the inlet of the conduit of the toilet main unit are not connected in a correctly watertight manner.

FIG. 11B is a summary diagram showing, as a comparative example to the flush toilet according to the first embodiment of the invention shown in FIG. 11A, that because the reservoir tank orientation is tilted when the reservoir tank is assembled to a predetermined installation position, and the center axis of the outlet of the reservoir tank and the center axis of the inlet of the conduit of the toilet main unit are mutually offset, the communicating pipe portion of the connecting member in the segment from the outlet of the reservoir tank to the inlet of the conduit of the toilet main unit is not connected in a correctly watertight manner.

First, as shown in FIG. 10, a worker starts the installation before the pre-installation start state preceding the placement of a flush water outlet 4*a* according to an embodiment of the invention in a predetermined installation space S1 on the back side of the toilet main body 2.

Then, as shown in FIG. 10B, only the reservoir tank 20 is inserted into the installation space S1 from above while the supply valve apparatus 26, the jet pump unit 30, and the internal parts etc. relating thereto of the flush water tank apparatus 4 of the flush toilet 1 are not installed in the reservoir tank 20. This results in a first installation state in which only the reservoir tank 20 without internal parts installed is set into the predetermined installation space S1.

Next, after the first installation state shown in FIG. 10B, the connecting pipe member 52 is inserted from above into the reservoir tank 20, as shown in FIG. 10C. One end (the front end portion) of this communicating pipe portion 52*c* of the connecting pipe member 52 is inserted from inside the reservoir tank 20, through the outlet 20*b* in the front wall portion 20*a* of the reservoir tank 20, into the inlet 14*a* on the conduit 14 of the toilet main body 2.

At this point, as shown in FIGS. 10C and 11A, the communicating pipe portion 52*c* of the connecting pipe member 52 and the outlet 20*b* in the front wall portion 20*a* of the reservoir tank 20 are connected in a watertight manner by the packing 56. At the same time, a second installation state is achieved in which the communicating pipe portion 52*c* of the connecting pipe member 52 and the inlet 14*a* of the conduit 14 of the toilet main body 2 are connected in a watertight manner by the packing 50.

Next, after the second installation state shown in FIG. 10C, the supply valve apparatus 26, the jet pump unit 30, and the internal parts related thereto of the flush water tank apparatus 4 of the flush toilet 1 are installed in the reservoir tank 20, as shown in FIGS. 5 and 10D. A third installation state is then achieved in which a portion thereof (the throat pipe-side connecting portion 54 forming the outlet 40*b* on the throat pipe 40) is connected to the top end portion 52*b* of the connecting pipe member 52.

Note that in the present embodiment the communicating pipe portion 52*c* of the connecting pipe member 52 and the outlet 20*b* on the front wall portion 20*a* of the reservoir tank 20 are connected in a watertight manner. At the same time, a second installation state is achieved in which the communicating pipe portion 52*c* of the connecting pipe member 52 and the inlet 14*a* of conduit 14 of the toilet main body 2 are connected in a watertight manner by the packing 50. The third installation state achieved after this second installation state is explained, when the supply valve apparatus 26, the jet pump unit 30, and related internal parts are installed into the reservoir tank 20, and the throat pipe-side connecting portion 54 is connected to the top end portion 52*b* of the connecting pipe member 52. However, the supply valve apparatus 26, the jet pump unit 30, and related internal parts as well as the connecting pipe member 52 may also be assembled together onto the reservoir tank 20.

Next, after the third installation state shown in FIG. 10D, the degree of tightening of the bolt operating portion 78 of the bolt 72 is adjusted using the affixing devices 66, as shown in FIGS. 6-8. While adjusting in this manner, the base portion 20*c* at the rear surface and on both sides of the reservoir tank 20 is affixed to the toilet main body 2 so that the orientation of the reservoir tank 20 is maintained in a horizontal state.

Then, as shown in FIG. 9, it is confirmed that the push-in depth confirmation line L1 is parallel to the toilet main unit-side confirmation line L2 on the toilet main unit side. At the same time, it is confirmed to essentially match the height positions of both L1 and L2.

In addition, if it cannot be confirmed that the reservoir tank 20 is correctly installed at the predetermined installation position on the rear side of the toilet main body 2, the tank cover 2*a* is attached to the top end portion of the installation space S1 of the reservoir tank 20 on the rear side of the toilet main body 2. Thus the state shown in FIG. 1 is achieved, in which installation is complete.

At this point, as shown in FIG. 5, the communicating path (connecting pipe path 52*a*) of the communicating pipe portion 52*c* in the segment from the outlet 20*b* of the reservoir tank 20 to the inlet 14*a* on the conduit 14 of the toilet main body 2 is positioned to a horizontal state.

In addition, as shown in FIG. 11A, the center axis A1 of the packing 56 at the outlet 20*b* of the reservoir tank 20, the center axis A2 of the packing 50 at the inlet 14*a* of the conduit 14 of the toilet main body 2, and the center axis A3 of the connecting pipe path 52*a* in the communicating pipe portion 52*c* of the connecting pipe member 52 are in mutually matched positions.

Meanwhile, as shown in FIGS. 9 and 11B, if it cannot be confirmed that the reservoir tank 20 is correctly installed at the predetermined installation position on the rear side of the toilet main body 2, there is a risk that the orientation inside the reservoir tank 20 is not in a horizontal state. Therefore the position of the reservoir tank 20 can be shifted within the range of the tank-affixing long hole 20*d* on the base portion 20*c* of the reservoir tank 20 without removing the reservoir tank 20 from the installation position. The relative positions of the reservoir tank 20 to the toilet main body 2 inside the installation space S1 are adjusted in the front-back direction and left-right direction, etc. and, as shown in FIGS. 6-8, the degree of tightening of the bolt operating portion 78 of the affixing devices 66 is again adjusted. While adjusting these, the amount of elastic deformation of the rubber bushing 68, the flexible member 70, and the like are adjusted. Thus, as shown in FIG. 9, fine-tuning such as adjustment of the height position of the reservoir tank 20 relative to the toilet main body 2 is performed until the correct installation state is achieved.

In the flush toilet 1 according to an embodiment of the invention, the affixing devices 66, assembled into the predetermined installation space S1 to the rear of the bowl 6 of the toilet main body 2, are disposed on the toilet main body 2 and the reservoir tank 20 as horizontal adjustment portions capable of adjusting the orientation of the reservoir tank 20 to a horizontal state. With the affixing device 66 serving as horizontal adjustment portion, there is also a rubber bushing 68, a flexible member 70, a bolt 72 including a bolt operating portion 78, a metal washer 74, and a spring washer 76. Therefore even if the reservoir tank 20 is assembled in a tilted state into the predetermined installation space S1 behind the bowl 6 of the toilet main body 2 in a tilted state and affixed to the toilet main unit 2 by the affixing device 66, the orientation of the reservoir tank 20 can be adjusted to a horizontal state by the horizontal adjustment portions 68, 70, 72, 74, 76, and 78 of the affixing devices 66*c*.

Hence, for example, a reservoir tank 20 can be achieved in which the depth inside the reservoir tank 20 is relatively shallow and the top edge height of the reservoir tank 20 is low (a "low-silhouette tank"), so that it is compact in both the front-back direction (depth direction) and the left-right direction (width direction). Hence a low silhouette with reduced height and greater compactness can be achieved for the flush toilet 1 as a whole.

Also, reductions in the amount of flush water inside the reservoir tank 20 drawn in by the jet pump action of the jet pump unit 30 inside the tank due to tilting of the reservoir tank 20 and the water level inside it can be suppressed. Thus degradation of jet pump performance can be reduced.

Therefore the amount of flush water supplied to the toilet main body 2 from the reservoir tank 20 can be stabilized. This means that a reduction in cleaning performance and water conservation performance can be suppressed.

In the comparative example of the flush toilet 1 according to the embodiment of the invention shown in FIG. 11*b*, if the center axis A1 of the outlet 20*b* of the reservoir tank 20 is offset from the center axis A2 of the inlet 14*a* of the conduit 14 of the toilet main body 2 (see FIG. 11B), the vector of the flush water flow from the communicating path (connecting pipe path 52*a*) of the communicating pipe portion 52*c* of the connecting pipe member 52 in the downstream side flow path (e.g., the conduit 14 of the toilet main body 2, etc.) would change. Thus there is a risk on the reservoir tank 20 side as well that the amount of flush water in the reservoir tank 20 drawn in by the jet pump action of the jet pump unit 30 will decline, causing jet pump performance to decline.

In contrast, by using a flush toilet 1 according to an embodiment of the invention, as shown in FIGS. 5 and 11A, the affixing devices 66, which are a horizontal adjustment portion, include a flexible member 70. This flexible member 70 is a positioning member capable of positioning the communicating path (connecting pipe path 52*a*) of the communicating pipe portion 52*c* of the connecting pipe member 52 into a horizontal state in the segment from the outlet 20*b* of the reservoir tank 20 to the inlet 14*a* of the conduit 14. Thus after the reservoir tank 20 is assembled into the toilet main body 2 predetermined installation space S1, the connecting pipe member 52 communicating pipe portion 52*c* connecting pipe path (connecting pipe path 52*a*) in the segment from the outlet 20*b* of the reservoir tank 20 to the inlet 14*a* of the conduit 14 or the toilet main body 2 can be easily positioned to a horizontal state by the flexible member 70. Thus position matching between the center axis A1 of the outlet 20*b* of the reservoir tank 20 and the center axis A2 of the inlet 14*a* of the conduit 14 of the toilet main body 2 can be easily accomplished.

Therefore changes in the flow vector of flush water flowing from the communicating pipe portion 52*c* of the connecting pipe member 52 to the conduit 14 of the toilet main body 2 on the downstream side thereof can be suppressed. Thus on the reservoir tank 20 side as well, a drop in the amount of flush water drawn into the reservoir tank 20 by the jet pump action of the jet pump unit 30 can be suppressed. Hence, degradation of jet pump performance can be suppressed.

In addition, by using the flush toilet 1 according to an embodiment of the invention, the reservoir tank 20 is affixed to the toilet main body 2 by the affixing devices 66 after it is assembled in the predetermined installation space S1 of the toilet main body 2. If in this affixed state the need arises to fine-tune the height position of the reservoir tank 20 or fine tune the orientation of the reservoir tank 20 to a horizontal state, for example, it is not necessary to remove the reservoir tank 20 from its predetermined installation space S1 behind the bowl 6. Thus simply by adjusting the degree of deformation of the flexible member 70 or the degree of tightening between the toilet main body 2 and the reservoir tank 20 by operating the bolt operating portion of the horizontal adjustment portion (bolt operating portion 78), it is possible to easily fine tune the height position of the reservoir tank 20 relative to the toilet main body 2, or to easily fine tune the orientation of the reservoir tank 20 to a horizontal state.

Therefore by maintaining the orientation of the reservoir tank 20 in a horizontal state, a drop in the amount of flush water in the reservoir tank 20 drawn in by the jet pump action of the jet pump unit 30 can be suppressed. Degradation of jet pump performance can also be suppressed.

In addition, in the flush toilet 1 according to an embodiment of the invention, with the reservoir tank 20 assembled into a predetermined installation space S1 in the toilet main body 2, the seal members (packing 50, 56) include a packing 56, being the seal portion on the tank outlet side, attached to the outlet 20*b* of the reservoir tank 20, and a packing 57, being a toilet main unit inlet-side seal portion, attached to the inlet 14*a* of the conduit 14 of the toilet main body 2. The horizontal adjustment portions 66, 68, 70, 72, 74, 76, and 78 enable mutual position matching of the center axis of the tank outlet-side seal portion (packing 56) (the center axis A1 of the outlet 20*b* of the reservoir tank 20), the center axis of the toilet main unit inlet-side seal portion (packing 50) (the center axis A2 of the inlet 14*a* of the conduit 14 of the toilet main body 2), and the center axis A3 of the communicating path (connecting pipe path 52*a*) of the communicating pipe portion 52*c* of the connecting pipe member 52. Sealing characteristics in the outlet 20*b* of the reservoir tank 20 or the inlet 14*a* of the conduit 14 of the toilet main body 2 can thus be improved, and a more securely watertight connection can also be made between the tank outlet-side seal portion (packing 56), the toilet main unit inlet-side seal portion (packing 50), and the communicating pipe portion 52*c* of the connecting pipe member 52.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet configured to discharge waste by flushing the flush toilet with flush water supplied by a jet pump action, the flush toilet comprising:

a toilet main unit including a bowl configured to receive waste, a conduit configured to guide flush water to the bowl, and an installation space being formed behind the bowl and being downwardly recessed from a top of the toilet main unit, the conduit including an inlet which is formed to open in a horizontal front-back direction of the toilet main unit;

a tank installed within the installation space, the tank being configured to store a portion of flush water supplied from a supply source and to supply flush water to the conduit in the toilet main unit;

a seal member connected in a watertight manner to an outlet of the tank and the inlet of the conduit of the toilet main unit, respectively; and a connecting member configured to connect the tank to the toilet main unit in a watertight manner through the seal member with the connecting member which is inserted in the tank after the tank is installed in the installation space, wherein the connecting member includes a communicating pipe portion configured to communicate the conduit of the toilet main unit and an interior of the tank when one end of the connecting member is inserted from the interior of the tank through the outlet of the tank into the inlet of the conduit of the toilet main unit, wherein the communicating pipe portion extends from the one end to another end of the connecting member, and wherein the other end bends upward;

wherein the tank includes a jet pump unit and a supply valve in the tank, at least part of the jet pump unit being submerged, and the supply valve being configured to supply and shut off flush water supplied from the supply source to the jet pump unit in response to a water level inside the tank; and wherein the jet pump unit includes a jet nozzle configured to jet flush water supplied from the supply source, and a throat pipe including a suction port at one end of the throat pipe and an outlet at other end of the throat pipe, the outlet of the throat pipe being connected to the communicating pipe portion;

wherein the jet nozzle being configured to induce a jet pump action so as to increase a flow volume of flush water flowing in the throat pipe more than a flow volume of flush water jetted from the jet nozzle by jetting flush water from the suction port toward an interior of the throat pipe so that increased flow volume of flush water is supplied from the throat pipe toward the conduit of the toilet main unit; and the flush toilet further comprises a horizontal adjustment portion, the horizontal adjustment portion being configured to adjust an orientation of the tank to a horizontal state after the tank is installed within the installation space and after the tank and the toilet main unit are connected by the connecting member in a watertight manner through the seal member.

2. The flush toilet according to claim 1, wherein the horizontal adjustment portion includes a positioning member configured to position a communicating path in a segment of the communicating pipe portion from the outlet of the tank to the inlet of the conduit of the toilet main unit to the horizontal state.

3. The flush toilet according to claim 2, wherein the horizontal adjustment portion includes an operating portion interposed between the toilet main unit and the tank, the operating portion being configured to adjust a height position of the tank after the tank is assembled within the installation space behind the bowl of the toilet main unit.

4. The flush toilet according to claim 1, wherein the seal member includes a tank outlet-side seal portion and a toilet main unit inlet-side seal portion, wherein the tank outlet-side seal portion is attached to the outlet of the tank, and the toilet main unit inlet-side seal portion is attached to the inlet of the toilet main unit with the tank being installed within the installation space; and wherein the horizontal adjustment portion is configured to match positions among a center axis of the tank outlet-side seal portion, a center axis of the toilet main unit inlet-side seal portion, and a center axis of the communicating path in the communication pipe portion.

5. The flush toilet according to claim 1, wherein the horizontal adjustment portion is provided on an outside surface of an outer portion of the tank.

6. The flush toilet according to claim 5, wherein the horizontal adjustment portion is provided on each base portion at left and right sides of a back surface of the tank.

* * * * *